US008376050B2

(12) United States Patent
Cumming et al.

(10) Patent No.: US 8,376,050 B2
(45) Date of Patent: Feb. 19, 2013

(54) SAMPLING SKID FOR SUBSEA WELLS

(75) Inventors: Mike Cumming, York (GB); Alan Dawson, Aberdeen (GB); Roger Osborne, Houston, TX (US)

(73) Assignee: Cameron International Corporation, Houston, TX (US)

( * ) Notice: Subject to any disclaimer, the term of this patent is extended or adjusted under 35 U.S.C. 154(b) by 57 days.

(21) Appl. No.: 12/822,728

(22) Filed: Jun. 24, 2010

(65) Prior Publication Data

US 2011/0005765 A1 Jan. 13, 2011

Related U.S. Application Data

(60) Provisional application No. 61/220,466, filed on Jun. 25, 2009.

(51) Int. Cl.
*E21B 47/00* (2012.01)
*E21B 49/08* (2006.01)

(52) U.S. Cl. ..... 166/345; 166/338; 166/351; 166/366; 166/250.01; 166/264

(58) Field of Classification Search ..... 166/345, 166/338, 344, 347, 351, 352, 366, 368, 250.01, 166/264, 369, 373; 702/6, 12, 13
See application file for complete search history.

(56) References Cited

U.S. PATENT DOCUMENTS

| | | | | |
|---|---|---|---|---|
| 3,517,735 | A * | 6/1970 | Fairbanks et al. | 166/366 |
| 3,629,859 | A * | 12/1971 | Copland et al. | 702/188 |
| 3,760,362 | A * | 9/1973 | Copland et al. | 379/106.01 |
| 4,215,567 | A * | 8/1980 | Vlcek | 73/61.44 |
| 5,899,637 | A * | 5/1999 | Blanchard et al. | 405/210 |
| 6,435,279 | B1 * | 8/2002 | Howe et al. | 166/336 |
| 6,499,344 | B2 * | 12/2002 | Nelson et al. | 73/152.23 |
| 6,659,177 | B2 * | 12/2003 | Bolze et al. | 166/264 |
| 6,840,088 | B2 * | 1/2005 | Tucker et al. | 73/49.5 |
| 6,913,083 | B2 * | 7/2005 | Smith | 166/336 |
| 7,178,591 | B2 * | 2/2007 | Del Campo et al. | 166/264 |
| 7,273,105 | B2 * | 9/2007 | Johansen et al. | 166/336 |
| 7,377,226 | B2 * | 5/2008 | Choi | 114/312 |
| 7,458,419 | B2 * | 12/2008 | Nold et al. | 166/100 |
| 7,484,563 | B2 * | 2/2009 | Zazovsky et al. | 166/264 |
| 7,565,835 | B2 * | 7/2009 | Bittleston et al. | 73/152.24 |
| 7,584,786 | B2 * | 9/2009 | Nold et al. | 166/100 |
| 7,650,944 | B1 * | 1/2010 | Boyle | 166/344 |
| 7,793,713 | B2 * | 9/2010 | Nold, III et al. | 166/100 |
| 7,841,402 | B2 * | 11/2010 | Georgi et al. | 166/250.12 |
| 7,913,554 | B2 * | 3/2011 | Bittleston et al. | 73/152.24 |
| 7,918,287 | B2 * | 4/2011 | Foley | 175/20 |
| RE42,358 | E * | 5/2011 | Tucker et al. | 73/49.5 |
| 7,934,547 | B2 * | 5/2011 | Milkovisch et al. | 166/105 |
| 8,047,286 | B2 * | 11/2011 | Zazovsky et al. | 166/264 |
| 8,122,965 | B2 * | 2/2012 | Horton et al. | 166/366 |
| 2005/0061513 | A1 * | 3/2005 | Johansen et al. | 166/336 |
| 2008/0179091 | A1 * | 7/2008 | Foley | 175/7 |
| 2011/0040501 | A1 * | 2/2011 | Martin et al. | 702/45 |

FOREIGN PATENT DOCUMENTS

WO 2008/087156 A1 7/2008

OTHER PUBLICATIONS

PCT/US2010/039808 International Search Report and Written Opinion, Jan. 5, 2011 (10 p.).

* cited by examiner

*Primary Examiner* — Matthew Buck
(74) *Attorney, Agent, or Firm* — Chamberlin Hrdlicka

(57) ABSTRACT

A system for sampling production well production fluids from a manifold interface panel on a subsea production manifold. In some embodiments, the system includes a remotely operated vehicle, a skid coupled to the remotely operated vehicle, a sample tank supported on the skid, and a fluid transfer pump operable to convey production fluid from at least one of the production wells through the manifold interface panel into the sample tank.

16 Claims, 2 Drawing Sheets

SAMPLING SKID FOR SUBSEA WELLS

CROSS-REFERENCE TO RELATED APPLICATIONS

This application claims benefit of U.S. Provisional Application Ser. No. 61/220,466 filed Jun. 25, 2009, and entitled "Sampling Skid for Subsea Wells," which is hereby incorporated herein by reference in its entirety for all purposes.

BACKGROUND

Subsea hydrocarbon fields may link multiple wells via flow lines to a shared production manifold that is connected to a surface facility, such as a production platform. Produced fluids from the wells are typically intermingled at the production manifold before flowing to the surface facility. The production from each well is monitored by a multiphase flow meter, which determines the individual flow rates of petroleum, water, and gas mixtures in the produced fluid.

Due to the depth of subsea hydrocarbon fields, servicing and monitoring equipment placed on the sea floor requires the use of underwater vehicles, such as remotely-operated vehicles (ROVs). ROVs can carry equipment to the sea floor from a surface ship or platform and manipulate valves and other controls on equipment located on the sea floor, such as wellheads and other production equipment. The ROV is controlled from the surface ship or platform by umbilical cables connected to the ROV. Subsea equipment carried by ROVs is typically on a skid attached to the bottom of the ROV. The ROV itself is used for maneuvering the skid into position. As subsea hydrocarbon fields continue to be more common, and at greater depths, additional abilities to perform maintenance and monitoring tasks using ROVs are desired.

A maneuverable skid for taking samples from one or more subsea wells and associated methods. In some embodiments, the skid is coupled to a remotely operated vehicle. The skid supports a plurality of sample tanks and a fluid transfer pump. The fluid transfer pump is operable to convey fluid between a manifold interface panel and each of the sample tanks.

SUMMARY OF THE DISCLOSED EMBODIMENTS

A system for sampling production well production fluids from a manifold interface panel on a subsea production manifold and associated methods are disclosed. In some embodiments, the system includes a remotely operated vehicle, a skid coupled to the remotely operated vehicle, a sample tank supported on the skid, and a fluid transfer pump operable to convey production fluid from at least one of the production wells through the manifold interface panel into the sample tank.

Some methods for sampling production fluids in a subsea location include deploying a sample skid using a remotely operated vehicle to a subsea production manifold, wherein the sample skid comprises a plurality of sample tanks and a fluid transfer pump; coupling the fluid transfer pump to a manifold interface panel, wherein the manifold interface panel is in fluid communication with a plurality of production wells; and delivering a predetermined quantity of production fluid from the first selected production well into a first of the sample tanks, wherein the predetermined quantity is less than the capacity of the first sample tank.

Some methods of sampling production well production fluids from a manifold interface panel on a subsea production manifold include coupling a sample skid to the manifold interface panel, the manifold interface panel being in fluid communication with at least one production well, coupling the fluid transfer pump to a manifold interface panel, wherein the manifold interface panel is in fluid communication with a production wells, and delivering a predetermined quantity of production fluid from the production well into a sample tank on the sample skid, wherein the predetermined quantity is less than the capacity of the sample tank.

Some methods for removing a hydrate blockage in a subsea location include deploying a sample skid using a remotely operated vehicle to a subsea production manifold, wherein the sample skid comprises at least one sample tank and a fluid transfer pump; coupling the fluid transfer pump to a manifold interface panel, wherein the manifold interface panel is in fluid communication with a plurality of production wells; and extracting production fluid from behind a hydrate blockage formed in a flow line in fluid communication with one of the production wells.

Some methods of removing a hydrate blockage from a flow line in communication between a production well and a subsea production manifold comprising a manifold interface panel include deploying a sample skid to the subsea production manifold and coupling the sample skid to the manifold interface and extracting production fluid from behind a hydrate blockage formed in the flow line in fluid communication with one of the production wells to the sample skid.

Thus, embodiments described herein comprise a combination of features and advantages that enable sampling of production fluids from multiple wells in a subsea hydrocarbon field. The various characteristics described above, as well as other features, will be readily apparent to those skilled in the art upon reading the following detailed description of the preferred embodiment, and by referring to the accompanying drawings.

BRIEF DESCRIPTION OF THE DRAWINGS

For a more detailed description of the embodiments, reference will now be made to the following accompanying drawings.

DETAILED DESCRIPTION OF THE DISCLOSED EMBODIMENTS

Figure 1:
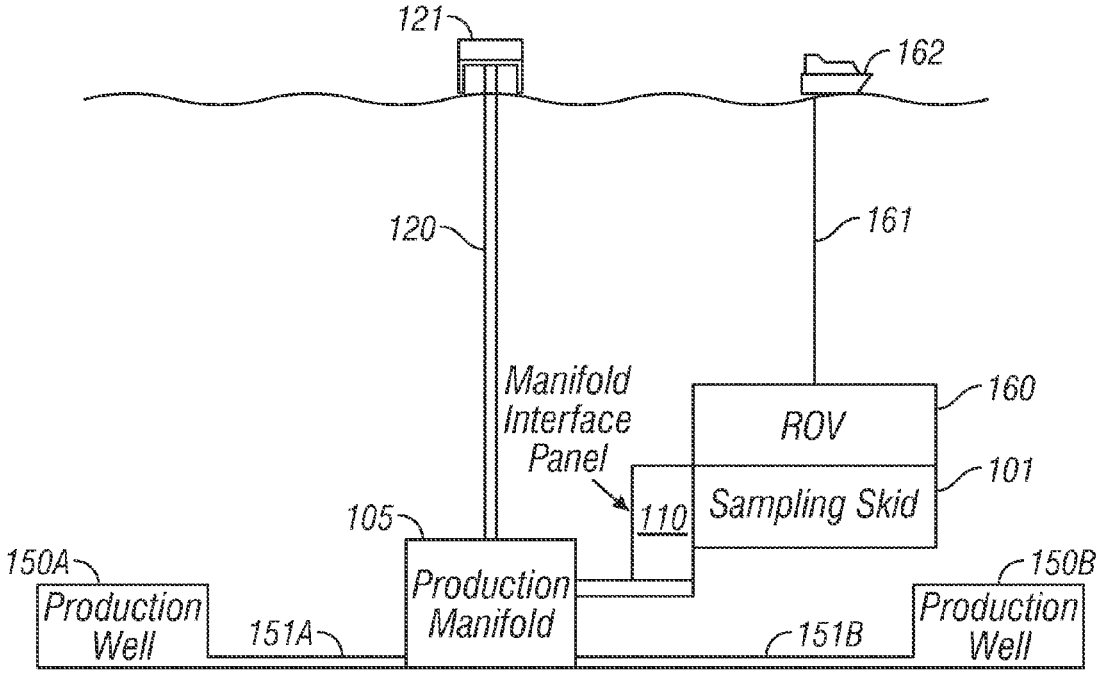
FIG. 1 is a schematic representation of a sampling skid deployed to a subsea location using a remotely operated vehicle in accordance with one embodiment.

The following description is directed to exemplary embodiments of a ROV-controlled skid for taking samples from one or more subsea wells and associated methods. The embodiments disclosed should not be interpreted, or otherwise used, as limiting the scope of the disclosure, including the claims. One skilled in the art will understand that the following description has broad application, and that the discussion is meant only to be exemplary of the described embodiments, and not intended to suggest that the scope of the disclosure, including the claims, is limited to those embodiments.

Certain terms are used throughout the following description and claims to refer to particular features or components. As one skilled in the art will appreciate, different persons may refer to the same feature or component by different names. This document does not intend to distinguish between components or features that differ in name but not function. Moreover, the drawing figures are not necessarily to scale. Certain features and components described herein may be shown exaggerated in scale or in somewhat schematic form, and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices and connections.

In FIG. 1, a schematic representation of a sampling skid 101 for extracting production fluids in a subsea location is shown in accordance with one embodiment. The sampling skid 101 is attached to a ROV 160 and deployed from a surface location, such as a ship 162. An umbilical cable 161 allows for control of the ROV 160 and sampling skid 101 from the surface location. The ROV 160 maneuvers the sampling skid 101 into position to connect to a manifold interface panel 110, which is part of a production manifold 105. The ROV 160 may also be used to manipulate valves on the production manifold 105 and the manifold interface panel 110 in preparation for extracting production fluids through the manifold interface panel 110.

The production manifold 105 serves as a hub for production wells 150A, 150B, which are connected, respectively, to the production manifold 105 with flow lines 151A, 151B. It should be appreciated that the disclosure is not limited to any particular number of production wells. At the production manifold 105, production fluids from the production wells are comingled before flowing to a production facility, such as a production platform 121, through a flow line 120. The manifold interface panel 110 allows for the sampling skid 101 to draw production fluids from the individual production wells 150A, 150B before comingling occurs within the production manifold 105. Accordingly, the sampling skid 101 is able to retrieve samples of production fluids from each production well, which is not possible from the surface from the flow line 120 due to comingling of the production fluids at the sea floor.

Figure 2:
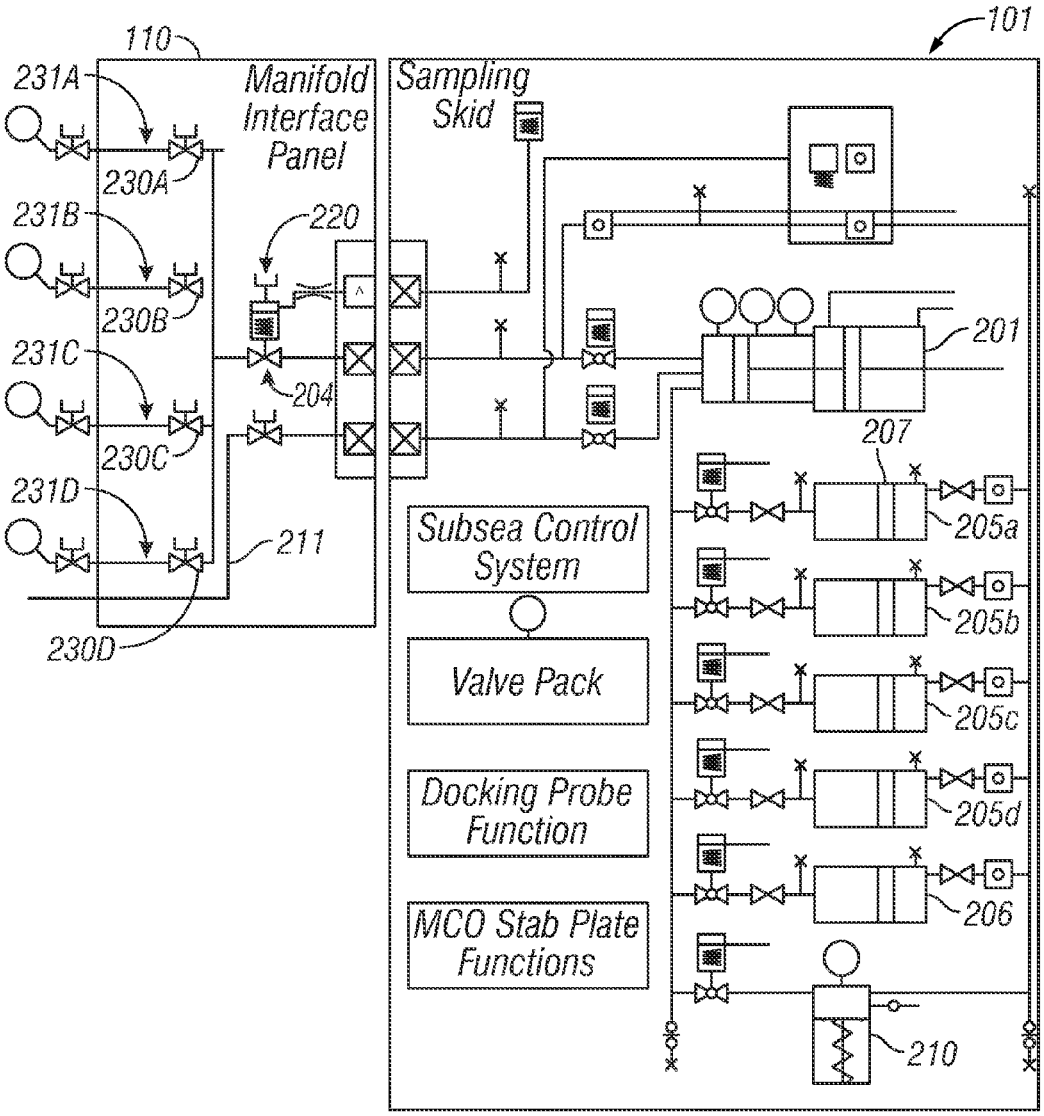
FIG. 2 is a schematic representation of a sampling skid in accordance with one embodiment.

In FIG. 2, the sampling skid 101 is schematically illustrated in accordance with one embodiment and configured to sample production fluids from four production wells A-D. The sampling skid 101 connects to the manifold interface panel 110, which is in fluid communication with the production wells A-D. Those having ordinary skill in the art will appreciate that the sampling skid 101 may be configured to extract production fluids from more than four production wells as well.

The sampling skid 101 is designed in part based on weight and size considerations corresponding to the ROV for which it is intended to be used. In the embodiment shown in FIG. 2, the sampling skid 101 includes up to four sample tanks 205*a-d*, one for each of the production wells A-D to be sampled. Each sample tank 205*a-d* is in selective fluid communication with a fluid transfer pump 201 located on the skid 101, which is configured to extract fluid through a sample line or inject a cleaning agent, such as methanol (MeOH), using connections with the manifold interface panel 110. The fluid transfer pump 201 allows for the sampling skid 101 to extract production fluids even when there is a negative pressure, meaning that the ambient pressure at depth is greater than the pressure of the production fluid being extracted. In one embodiment, the fluid transfer pump 201 is a piston pump with an infinitely variable pump rate to control fluid extractions. Moreover, in another embodiment, the fluid transfer pump 201 may be moved from the position illustrated by FIG. 2, meaning inline with sample line 204, and instead positioned between sample tanks 205*a-d* and slops tank 206.

Because the particular configuration of valves and lines may vary according to design preferences and specifications, the overall function of the schematically illustrated sampling skid 101 will now be described without reference to every particular valve or flow line within the sampling skid 101. In addition to the various valves and lines, the sampling skid 101 may include multiple test points (TP) for pressure and volume to allow for monitoring and confirmation throughout the sampling process. After docking with the manifold interface panel 110, a master control valve 220 controlling flow of production fluids from the manifold interface panel 110 is opened. The master control valve 220 may also be fail-safe valve that automatically closes in the case of pressure loss or loss of connection with the sampling skid 101, which minimizes discharge of production fluids. Each production well A-D is separated from the master control valve 220 by individual valves 231*a-d*, respectively, to allow for individual production fluid samples to flow through the master control valve 220 through the sample line 204 on the sampling skid 101. The individual valves 231*a-d* for each production well A-D may be controlled by physical manipulation from the ROV or pressure/electronic controls operated from the surface while the ROV is docked with the manifold interface panel 110. In one embodiment, external valves 230*a-d* may be provided outside of the interface panel between each production well A-D and the manifold interface panel 110. The external valves 230*a-d* may be opened by the ROV prior to docking with the manifold interface panel 110, and then closed by the ROV after undocking from the manifold interface panel 110.

Before extracting a production fluid sample, methanol may be pumped through the MeOH supply line 211 into the line from the particular production well being sampled. The MeOH combined with the production fluid may then be extracted by the fluid transfer pump 201 and diverted into a slops tank 206 in order to purge the lines of contaminants. After the purge, production fluids from the selected production well are diverted and/or pumped into the corresponding sample tank 205*a-d* until a desired sample volume is obtained. This process may then be repeated for as many of the production wells A-D as desired, with each well being sampled into a separate sample tank.

Each sample tank 205 may include a piston 207, which moves from left to right in the schematic illustration of FIG. 2 as production fluid fills the sample tank 205. Before deployment, one or more of the sample tanks 205*a-d* may be filled with methanol to minimize buoyancy of the sampling skid 101 and provide additional methanol for purging the lines, in addition to the methanol that may be stored in methanol supply tank 210. Each sample tank 250*a-d* filled with methanol is filled with methanol so as to position the piston 207 at the sample inlet end of the tank 250, which is to the left in FIG. 2. As production fluid fills the sample tank 205, the piston 207 moves away from the sample inlet end causing the methanol to exit the sample tank 205. In one embodiment, the sample tank 205 is only partially filled with production fluids to leave additional travel of the piston 207. For example, in one embodiment, the sample tank 205 has a volume of 5 liters, but is only filled with 4 liters of production fluids.

After sample extraction is complete for the desired number of production wells, the ROV brings the sampling skid 101 to the surface. The pressure differential from the sea floor to the surface may be problematic because the production fluids are multiphase fluids (oil, gas, and water), and the reduced pressure partially de-gasses the production fluids in the sample tanks 205. By not filling the sample tanks 205 completely, the piston 207 is able to move further in response to pressure by a process known as differential liberation from the release of dissolved gas to increase the volume inside the sample tank 205, which reduces the pressure inside the sample tanks 205*a-d*. By at least partially relieving the pressure, the sample tanks 205*a-d* are safer to handle at the surface. The additional step of transferring the production fluids from the sample tanks 205*a-d* to separate larger containers for transport may also be avoided. Minimizing transfers decreases the risk of contamination or changing the constituents of the multiphase production fluid samples, while also reducing the risk of accidental discharge into the environment. After being brought to the surface, the sampling skid 101 as a whole, or the individual sample tanks 205*a-d*, may be transported to a location onshore for analysis.

The abilities of the sampling skid outlined above to extract production fluids from live production wells may be used for extracting production fluids in various subsea applications in accordance with embodiments of the disclosure. In one embodiment, the samples taken by the sampling skid are used to verify the readings obtained from multiphase flow meters located at the subsea location. Because the life of the subsea hydrocarbon field may be for many years, even twenty or more years, periodic verification of the multiphase flow meters is useful to confirm their continued function. The sampling skid disclosed herein allows for multiple production wells to be sampled, and the readings of their corresponding multiphase meters confirmed, in a single trip.

In another embodiment, the sampling skid may be used to remove gas hydrate blockages in flow lines. Where water is present in gas being produced from a subterranean formation the problem of gas hydrate formation exists. Often gas produced from a subterranean formation is saturated with water so that formation of gas hydrates poses a very significant problem. Hydrates can form over a wide variance of temperatures up to about 25° C. Hydrates are a complex compound of hydrocarbons and water and are solid. Once a hydrate blockage occurs, pressure builds behind the hydrate blockage, which causes additional hydrates to form as a result of the increased pressure. To remove the hydrate blockage, the fluid transfer pump may be used to rapidly pump from the sample line to fill one or more of the sample tanks, which reduces the pressure behind the hydrate blockage to potentially dissolve the hydrates. In addition to the extraction, the sampling skid may also inject methanol, which helps to further dissolve and prevent hydrate formation. Instead of methanol, the sampling skid may be deployed with and may be able to inject other hydrate dissolving/inhibiting chemicals, such as the ICE-CHEK line of chemicals available from BJ Chemical Services, into the flow lines.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A system for sampling production well production fluids from multiple production wells from a manifold interface panel on a subsea multi-well production manifold, the system comprising:

a remotely operated vehicle;

a skid coupled to the remotely operated vehicle;

sample tanks supported on the skid; and a fluid transfer pump operable to convey production fluid from the production wells through the manifold interface panel into the sample tanks; and the sample tanks configured to keep fluid from each well separate.

2. The system of claim 1, further comprising a methanol supply tank in fluid communication with the fluid transfer pump and a sample flow line coupled between the fluid transfer pump and at least one subsea production well.

3. The system of claim 2, wherein the fluid transfer pump is operable to deliver methanol from the methanol supply tank into the sample flow line and to extract a mixture of the methanol and production fluid from the sample flow line.

4. The system of claim 3, further comprising a slops tank in fluid communication with the fluid transfer pump and wherein the fluid transfer pump is operable to deliver the mixture into the slops tank.

5. The system of claim 1, where the sample tanks each comprise a housing and a piston moveable therein.

6. The system of claim 5, wherein the piston separates the housing into two chambers and wherein each sample tank further comprises methanol stored in one of the chambers.

7. The system of claim 6, wherein each sample tank can receive production fluid, whereby in each sample tank, the piston moves within the housing and methanol is exhausted.

8. The system of claim 7, wherein the chamber containing methanol is in fluid communication with a methanol storage tank.

9. The system of claim 6, wherein the fluid transfer pump is operable to deliver production fluid from a subsea production well to the other of the chambers.

10. The system of claim 9, wherein the piston is movable under pressure from the production fluid.

11. A method of sampling production well production fluids from multiple production wells from a manifold interface panel on a subsea multi-well production manifold, the method comprising:

using a remotely operated vehicle to maneuver a sample skid into position to couple to the manifold interface panel;

releasably coupling the sample skid to the manifold interface panel, the manifold interface panel being in fluid communication with the production wells;

pumping production fluid from the production wells into different sample tanks on the sample skid, keeping the production fluids from each production well separate while stored on the sample skid.

12. The method of claim 11, further comprising:

injecting cleaning fluid from the skid through the manifold interface panel into a flow line in fluid communication with one of the production wells;

extracting a mixture of the cleaning fluid and production fluid from the flow line; and delivering the mixture from the flow line to a slops tank supported on the skid.

13. The method of claim 12, further comprising:

exhausting a buoyancy fluid from one of the sample tanks as the production fluid is delivered to the sample tank.

14. The method of claim 13, further comprising:

moving a piston within one of the sample tank as a volume of fluid in the sample tank increases.

15. The method of claim 12, further comprising:

delivering a predetermined quantity of production fluid from the production well into one of the sample tanks, wherein the predetermined quantity is less than the capacity of the sample tank.

16. The method of claim 11, further comprising pumping a quantity of production fluid into one of the sample tanks that is less than the capacity of the sample tank.

* * * * *